US007520022B2

(12) United States Patent
Conway et al.

(10) Patent No.: US 7,520,022 B2
(45) Date of Patent: Apr. 21, 2009

(54) SPRING AND HINGE ASSEMBLY FOR INSTALLING A DOOR ON TOILET PARTITIONS

(75) Inventors: William Conway, Moorpark, CA (US); Dikran Babikian, Glendale, CA (US); Douglas Murphy, Glendora, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 260 days.

(21) Appl. No.: 11/101,304

(22) Filed: Apr. 7, 2005

(65) Prior Publication Data

US 2006/0225245 A1 Oct. 12, 2006

(51) Int. Cl.
*E05F 1/14* (2006.01)

(52) U.S. Cl. ..... 16/285; 16/256; 16/307; 16/308; 16/336

(58) Field of Classification Search ..... 16/277, 16/280, 285, 255, 256, 295, 304, 305, 307, 16/308, 335, 336, 373, 401, DIG. 10; 119/516, 119/524; 49/386, 399, 414, 445
See application file for complete search history.

(56) References Cited

U.S. PATENT DOCUMENTS 529,312 A * 11/1894 Riley ..... 16/373
724,039 A * 3/1903 Peterkin ..... 16/285
882,289 A * 3/1908 Bommer ..... 16/307
926,520 A * 6/1909 Thornton et al. ..... 16/50
1,084,111 A * 1/1914 Schmidt ..... 16/305
1,230,555 A * 6/1917 Brennecke ..... 351/63
1,384,260 A * 7/1921 Kanter ..... 16/307
1,715,590 A * 6/1929 Burhenne ..... 292/228
1,892,584 A * 12/1932 Olson ..... 16/307
1,925,945 A * 9/1933 Zielinski et al. ..... 16/76
2,174,430 A * 9/1939 Valentine et al. ..... 220/829
2,497,266 A * 2/1950 Levane ..... 16/256
2,807,043 A * 9/1957 Gordon ..... 16/307
2,853,924 A * 9/1958 Herzfeld et al. ..... 351/113
2,867,842 A * 1/1959 Morton ..... 16/256
3,106,010 A * 10/1963 Morrell ..... 29/11
3,329,991 A * 7/1967 Gobble ..... 16/50
3,737,182 A * 6/1973 Sharpe ..... 403/187

(Continued)

OTHER PUBLICATIONS

Internet Address: http://www.irvinesprings.com/torsion_springs.htm; "Torsion Springs UK from Irvine Springs"; Irvine Spring Company Ltd., UK; one sheet.

(Continued)

*Primary Examiner*—William L. Miller
(74) *Attorney, Agent, or Firm*—Christie, Parker & Hale, LLP

(57) ABSTRACT

A hinge assembly comprises a first hinge half, a second hinge half, a spring, and a pin passing through the spring joining the first hinge half and the second hinge half. The spring in turn comprises a coil body, a first spring arm extending from the coil body having a first distal end portion, a second spring arm extending from the coil body having a second distal end portion, a first support extending from the first distal end portion towards the first hinge half and bearing on the first hinge half, and a second support extending from the second distal end portion towards the second hinge half and bearing on the second hinge half.

23 Claims, 6 Drawing Sheets

U.S. PATENT DOCUMENTS

| | | | | | |
|---|---|---|---|---|---|
| 4,193,164 | A * | 3/1980 | Okayama | 16/297 |
| 4,823,438 | A * | 4/1989 | Roloff | 16/307 |
| 5,533,234 | A * | 7/1996 | Bizek | 16/308 |
| 5,771,539 | A * | 6/1998 | Wahlstedt et al. | 16/285 |
| 5,826,306 | A * | 10/1998 | Faubert et al. | 16/244 |
| 6,205,618 | B1 * | 3/2001 | Lee | 16/256 |
| 6,553,623 | B2 * | 4/2003 | Long | 16/285 |

OTHER PUBLICATIONS

Internet Address: http://www.houseofantiquehardware.com; House of Antique Hardware, Inc., Portland, Oregon; two sheets.

* cited by examiner

SPRING AND HINGE ASSEMBLY FOR INSTALLING A DOOR ON TOILET PARTITIONS

FIELD OF THE INVENTION

The present invention relates to a device for use with stall doors that may be found in public restrooms, and particularly to a reliable torsion spring and hinge assembly used to automatically return a stall door to a closed position.

BACKGROUND

Individual stalls in public area restrooms found in schools, airports, movie theaters, stadiums, and recreation parks, etc. are generally provided by subdividing walls in the form of separate vertical bathroom partitions installed after the restroom has been finished. When one end of a bathroom partition is mounted on a traditional wall, the other end of the partition generally terminates at a stile. These partition walls may be attached by brackets or other devices to a stile in a plane perpendicular to the stile. Stiles may be used to frame doors in bathroom compartments, wherein the door is mounted in line with and between two stiles. The stiles themselves may be anchored to the floor, hung from the ceiling, or both.

FIG. 1 shows a typical layout of a partition assembly used to enclose individual restroom stalls. An exemplary stall is provided enclosed by a side panel 17 and an inward swinging door 18 attached to a stile 16 as well as by the restroom walls themselves. In an alternative embodiment, a pair of stiles 16 may be provided on either side of the door 18. The door 18 is an inward swinging door which travels through an arc of approximately 90 degrees. The door may be mounted on the stile using a hinge 14, which may be a full length spring and hinge assembly, a full length cam and hinge assembly or a short barrel cam hinge. The door 18 may be provided with a stop 19 to prevent the door 18 from swinging past the fully closed position.

Another stall is provided for handicapped access consisting of side panels 17 and an outward swinging door 15 attached to a stile 16 using a hinge 13. The front of the stall is cordoned off by the door 15 and a connector panel 9 as well as the stiles 16 on which the door 15 and connector panel 9 are mounted. Depending on the installation, the door 15 can swing through an arc up to as much as approximately 180 degrees. The door 15 may also be provided with a stop 10 to prevent the door 15 from swinging past the fully closed position.

In general, inward swinging stall doors must remain closed or partially closed even if the stall is not in use. Outward swinging stall doors such as those used in handicapped accessible stalls are required to remain completely closed if the stall is not in use for safety and other reasons. Stall doors may be kept closed when not in use by a pre-loaded force of the spring where an institutional hinge is used, or by a cam which uses the door's own weight and gravity to induce the door to rotate. The spring and hinge assembly, also known as an institutional hinge, is desirable in certain situations because its simple and sturdy construction resists vandalism and because it provides greater privacy to an occupant of a stall in which it is installed by covering the majority of the gap between a stall door and stile on the hinge side.

Restroom stall doors in heavy use areas such as airports and recreation parks may be used as much as several hundred times a day. As such, where these doors are mounted using spring and hinge assemblies, the springs should preferably be able to function for at least several hundred thousand cycles before failing and requiring replacement. Torsion spring and hinge assemblies used currently do not meet these customer goals for partitions. It is important that a reliable device be provided which causes the stall door to come to a completely closed position on its own; otherwise it can be especially difficult for a person in a wheel chair to properly latch the door as they will need to manually pull the door in to do so.

In place of a torsion spring and hinge assembly, a cam and hinge assembly or short barrel cam hinges may be used which do not incorporate springs needing periodic replacement. However, these hinges require that the stile be properly aligned and upright to function properly, and do not provide the privacy of the torsion spring and hinge assembly due to the inherent gaps 11 and 12 present between the stiles 16 and the doors 15 and 18 respectively, of the stalls.

FIG. 2 shows an exploded front view of a known torsion spring 20 installed in a spring and hinge assembly. The hinge comprises two hinge halves 25 joined by a hinge pin 28 at knuckles 24. The torsion spring 20 includes spring arms 23 and a coil body 29 having a plurality of spring coils 21. In one embodiment, the coil body 29 is provided with twenty six coils. The hinge pin 28 is provided running through the coil body 29 of the torsion spring 20. The spring arms 23 of the torsion spring 20 extend outward to bear on the hinge halves 25 to exert a pre-load force on the hinge assembly. FIG. 3 shows an end view of the institutional hinge assembly of FIG. 2 having the torsion spring 20.

FIG. 4 shows an assembled end view of the spring and hinge assembly of FIG. 3. The torsion spring 20 consists of the coil body 29, as well as spring arms 23 which extend from the ends of the coil body 29. The spring arms 23 diverge from the spring coils 21 at the reverse bends 22. The right-hand spring arm 23 shown in FIG. 4 for example transitions briefly from a counter-clockwise bend to a clockwise bend at one of the reverse bends 22 to provide a 0.05" step s between the spring arm 23 and a line tangent to the spring coils 21 running in parallel with the spring arm 23. The reverse bends 22 are provided in order to create a pre-load force in the spring 20 when the spring is installed in a hinge assembly mounted on a stile. The reverse bends 22 also allow the spring arms 23 sufficient clearance from the hinge halves 25 to bear at least in part on the top surfaces of the hinge halves 25 rather than entirely against their edges, as would be the case with the embodiment shown were the reverse bends 22 not present.

Despite the reverse bend being a widespread feature among torsion springs in the art, it is especially common for these springs to fail under normal use at the location of the reverse bends that join the spring arms to the spring coils. A load placed on the spring arms 23 and counteracted by a reaction force induced in the coil body 29 will naturally tend to concentrate at the place where the spring arms 23 meet the coil body 29, placing a reverse tension on the material of the reverse bends 22 prior to transferring to the coil body 29 of the spring 20. Compounding this problem are the preexisting internal stresses in the material of the spring 20 in the vicinity of the reverse bends 22 caused by the creation of the reverse bends 22. Finally, there is the remaining wear as the spring 20 flexes the spring arms 23 against the edges of the hinge halves 25.

The confluence of these factors has a deleterious effect on the longevity of known torsion springs, and commonly causes them to fail in the area of the reverse bend in an unacceptably short time. The reliability of known torsion springs is much worse when used with a hinge on a door which opens to an angle greater than 90 degrees, as is often the case with stalls having outward swinging door designs. These failures lead to customer complaints due to toilet partition doors that remain in an open position but are required to be closed. Were a solution to this problem to be found, it would improve reliability and customer satisfaction as well as reduce the costs associated with field replacements of damaged spring and hinge assemblies, stocking and handling replacement spring and hinge assemblies.

SUMMARY

An exemplary embodiment of the present hinge assembly provides one or more of the following benefits. First, an institutional hinge assembly provides a user with more privacy within the stall than with barrel hinges. Furthermore, by having a spring loaded hinge rather than a cam hinge that operates using gravity, concerns over proper stile alignment are minimized. If a stile to which a door is attached using an institutional hinge is out of alignment, the door may still close. However, with a cam hinge, gravity works to keep the door open rather than closing it as it should. Known spring loaded hinges have used prior art springs which frequently break leaving stall doors in the open position and the door itself opened into the restroom walking space in the case of outward swinging doors. This impinges on the open space of the restroom, and may possibly injury a restroom user. Lastly, when known spring loaded hinges using prior art springs have failed in the past leaving the outswing doors of handicapped accessible stall doors in the open position, it has proven difficult for a handicapped user to close the door manually. An embodiment of the present hinge avoids one or more of these problems.

In an exemplary embodiment a hinge assembly comprises a first hinge half, a second hinge half, a spring, and a pin passing through the spring joining the first hinge half and the second hinge half. The spring in turn comprises a coil body, a first spring arm extending from the coil body having a first distal end portion, a second spring arm extending from the coil body having a second distal end portion, a first support extending from the first distal end portion towards the first hinge half and bearing on the first hinge half, and a second support extending from the second distal end portion towards the second hinge half and bearing on the second hinge half.

In another embodiment, a hinge assembly comprises a first hinge half having a first top surface and at least one raised knuckle rising above the first top surface, a second hinge half having a second top surface and at least one raised knuckle rising above the second top surface, a spring, and a pin passing through spring joining the first hinge half and the second hinge half. The spring in turn comprises a coil body, a first spring arm extending from a point on the coil body above the first top surface, a second spring arm extending from a point on the coil body above the second top surface.

In an exemplary embodiment a stall assembly comprises a hinge assembly, a stall door attached to the first hinge half, a partition stile attached to the second hinge half, and a spring. The hinge assembly comprises a first hinge half, a second hinge half and a pin joining the first hinge half and the second hinge half. The spring comprises a coil body through which the pin passes, a first spring arm extending from the coil body having a first distal end portion, a second spring arm extending from the coil body having a second distal end portion, a first support extending from the first distal end portion towards the first hinge half and bearing on the first hinge half, and a second support extending from the second distal end portion towards the second hinge half and bearing on the second hinge half.

Figure 1:
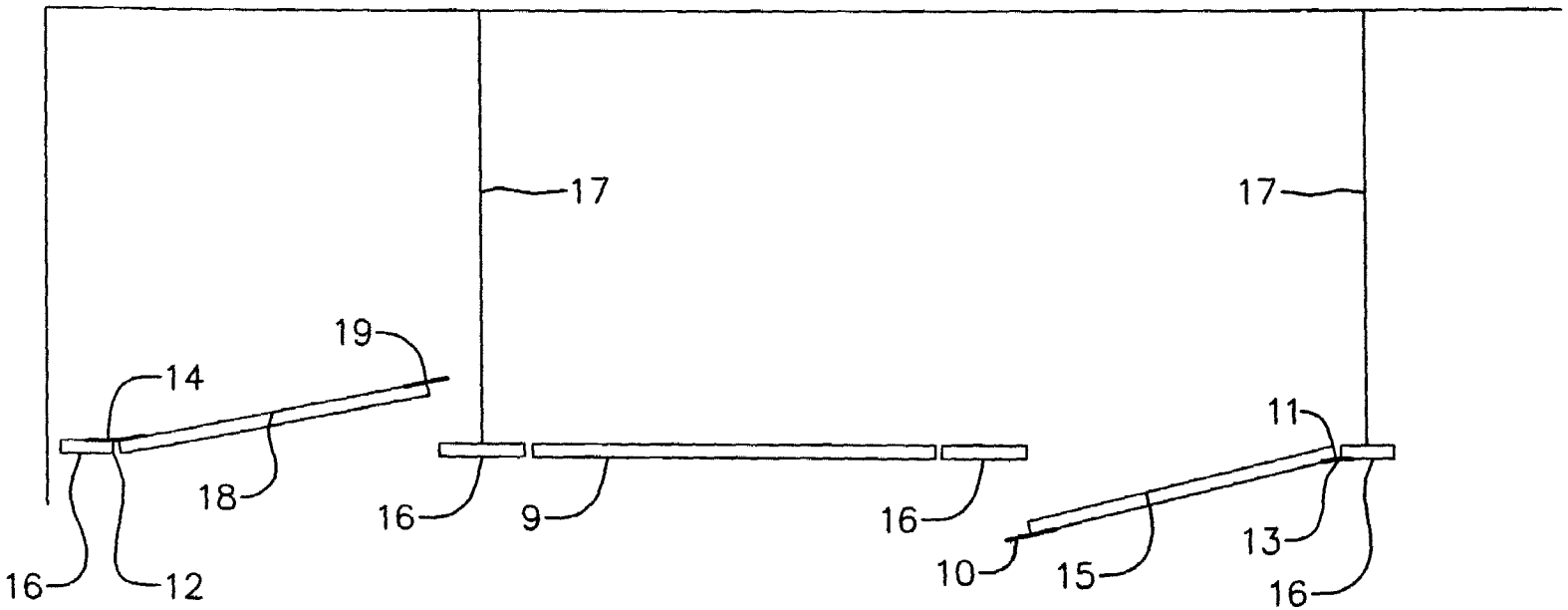
FIG. 1 shows an overhead view of a typical layout of a restroom partition assembly.
Figure 2:
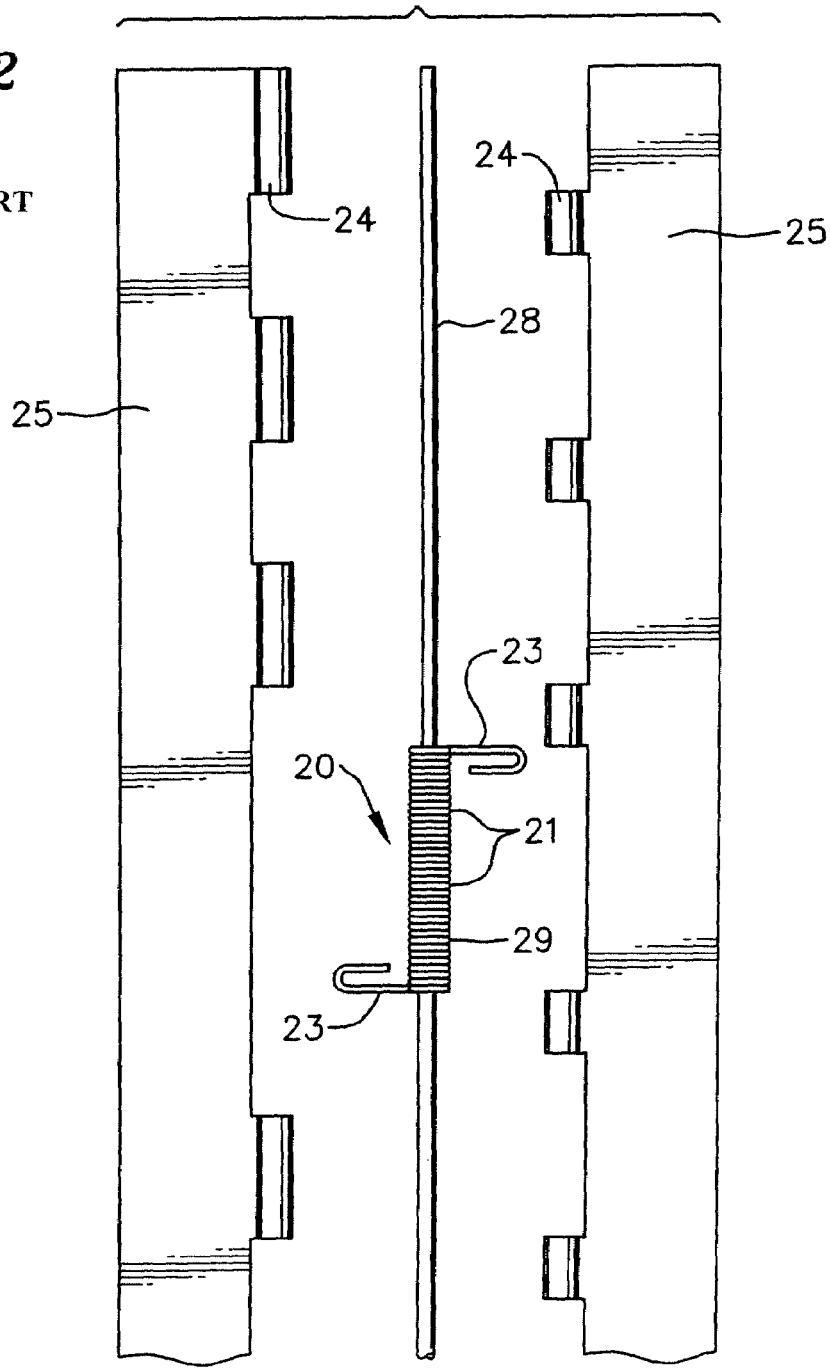
FIG. 2 PRIOR ART
FIG. 2 shows an exploded front view of a known torsion spring installed in a spring and hinge assembly.
Figure 3:
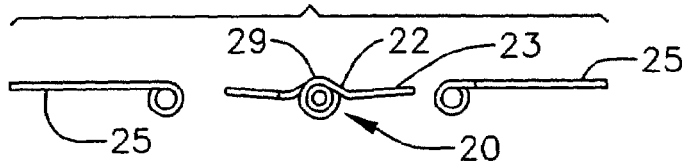
FIG. 3 PRIOR ART
FIG. 3 shows an end view of the spring and hinge assembly of FIG. 2.
Figure 4:
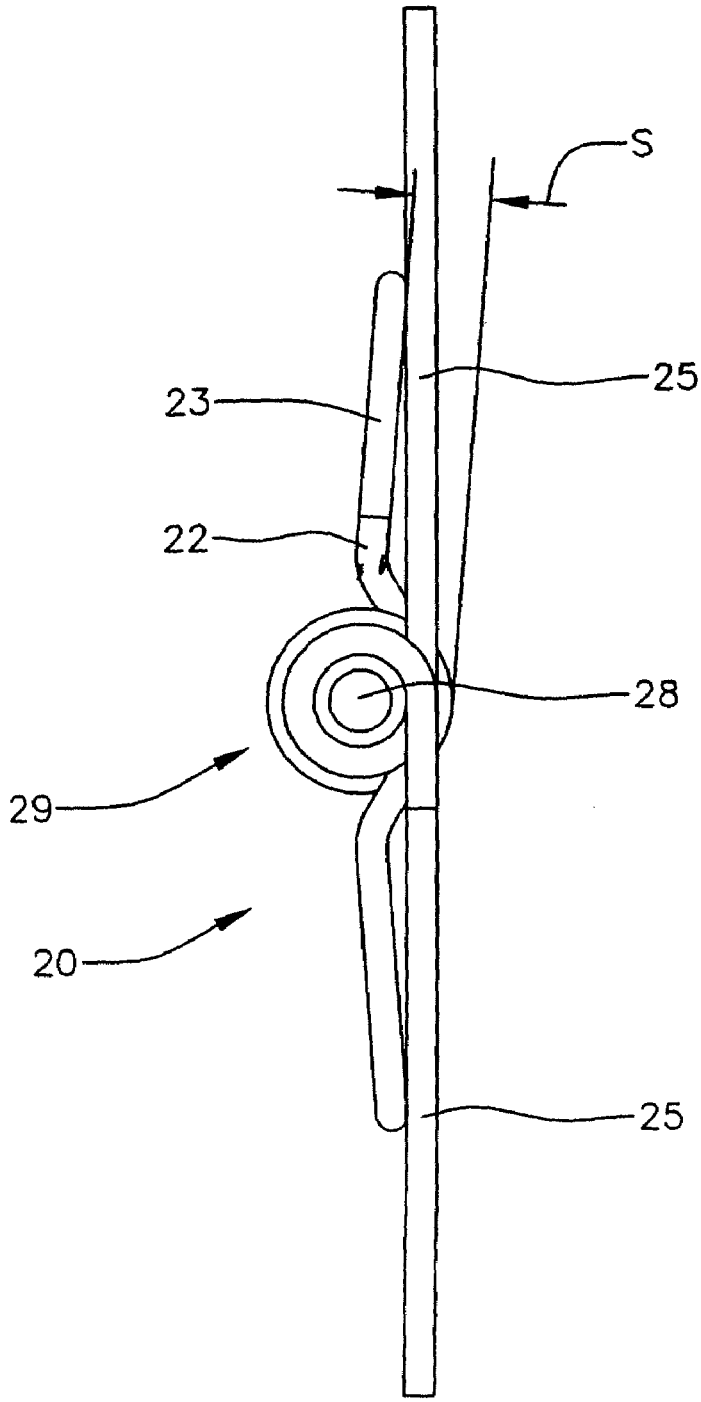
FIG. 4 PRIOR ART
FIG. 4 shows an assembled end view of the spring and hinge assembly of FIG. 3.

Before any embodiment of the invention is explained in detail, it is to be understood that the invention is not limited in its application to the details of construction and arrangements of components set forth in the following description, or illustrated in the drawings. The invention is capable of alternative embodiments and of being practiced or being carried out in various ways. For example, numerical dimensions and other specified numerical limitations, where they appear on the following drawings represent those of exemplary embodiments only and may be modified by one skilled in the art as conditions warrant. Also, it is to be understood, that the terminology used herein is for the purpose of illustrative description and should not be regarded as limiting.

DETAILED DESCRIPTION

In an exemplary embodiment, a new spring and hinge design is provided which maintains the benefits of previous designs while greatly improving the reliability of the spring. According to an exemplary embodiment, the reliability of the spring may be improved from several thousand cycles to several hundred thousand cycles.

Figure 5:
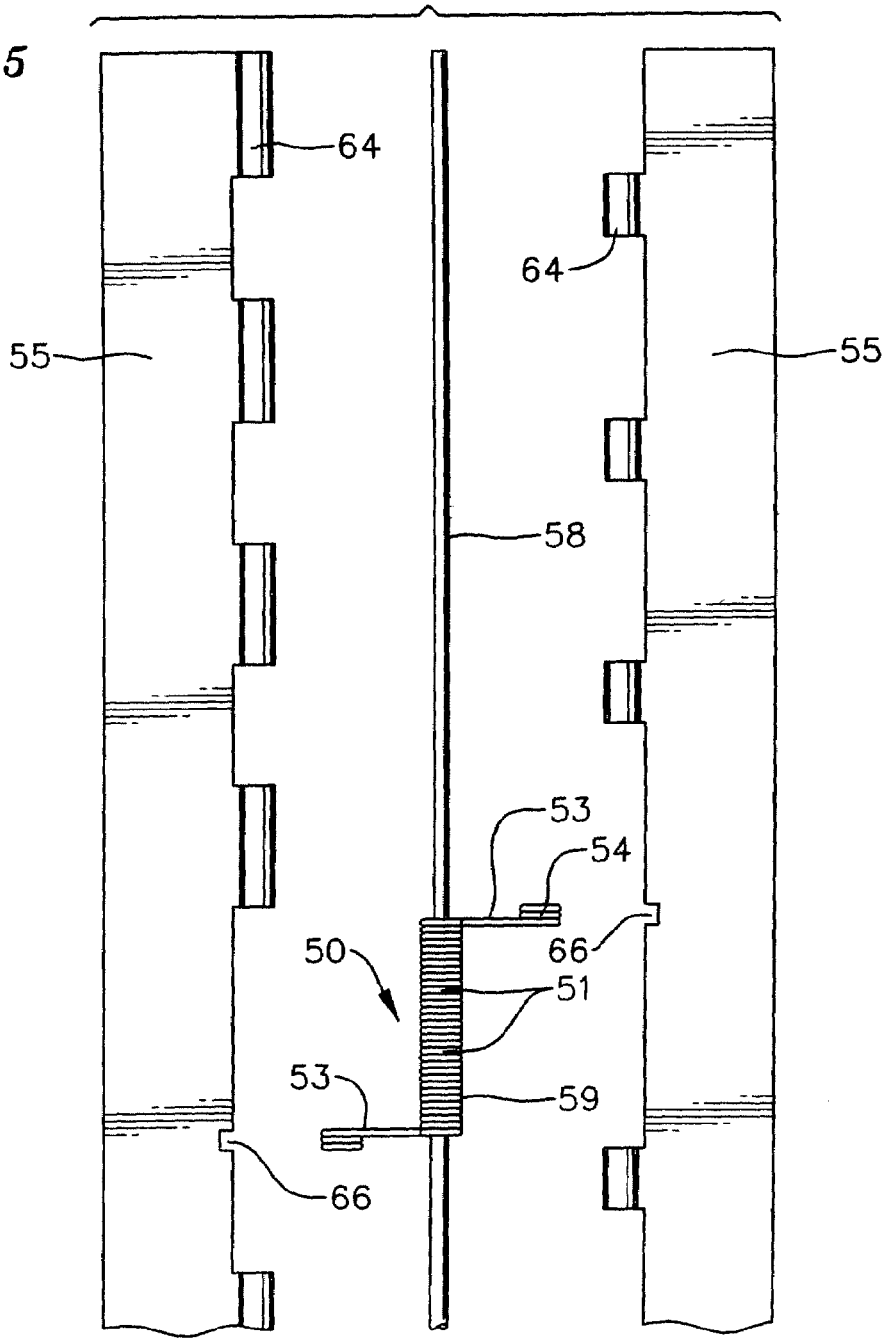
FIG. 5 shows an exploded front view of an exemplary torsion spring according to the present invention installed in a spring and hinge assembly.

FIG. 5 shows an exploded front view of an exemplary torsion spring 50 according to the present invention installed in a spring and hinge assembly. The hinge comprises two hinge halves 55 joined by a hinge pin 58 at knuckles 64. The torsion spring 50 is located on the hinge pin 58 between the hinge knuckles 64 of the hinge halves 55. The spring 50 has a coil body 59 with several spring coils 51 and a pair of spring arms 53 extending from the coil body 59. In one embodiment, the coil body 59 is provided with twenty eight coils. The hinge pin 58 runs through the coil body 59 of the torsion spring 50. The spring arms 53 of the torsion spring 50 extend outward to bear on the hinge halves 55 to exert a pre-load force on the hinge assembly.

Without the spring 50, the hinge halves 55 will swing freely on the axis of the hinge pin 58. When spring 50 is installed, it will force the hinge halves to rotate towards each other around the hinge pin. In order to further avoid friction between the spring arms 53 of the spring 50 and the edges of the hinge halves 55, the hinge halves 55 may be modified by adding notches 66 to remove material from the locations where the spring arms 53 would be in contact with the hinge halves 55. In an alternative embodiment, several torsion springs 50 may be provided on the hinge pin 58 between the hinge knuckles 64. In a further alternative embodiment, the notches 66 may be provided adjacent to the knuckles 64 on the hinge halves 55.

Figure 6:
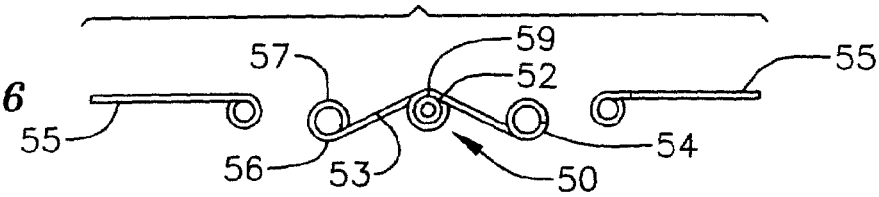
FIG. 6 shows an end view of the spring and hinge assembly of FIG. 5.

In an exemplary embodiment, a support has been added to the distal ends 56, shown in FIG. 6, of the spring arms 53 so that the distal ends may be spaced apart from a hinge surface when the torsion spring 50 is installed in a spring and hinge assembly. In the more specific embodiment shown in FIG. 5, the support comprises one or more spring loops 54, although it may also comprise a straight support bent perpendicularly to the spring arm 53 having an appropriately shaped end surface to contact the hinge surface, or another appropriately shaped support. The spring loops 54 may comprise multiple individual loops which taken together provide a line contact between the loops and the hinge halves 55, are more stable than a single loop, and reduce the chance of the spring arm 53 becoming twisted. FIG. 6 shows an end view of the spring and hinge assembly of FIG. 5.

Figure 7:
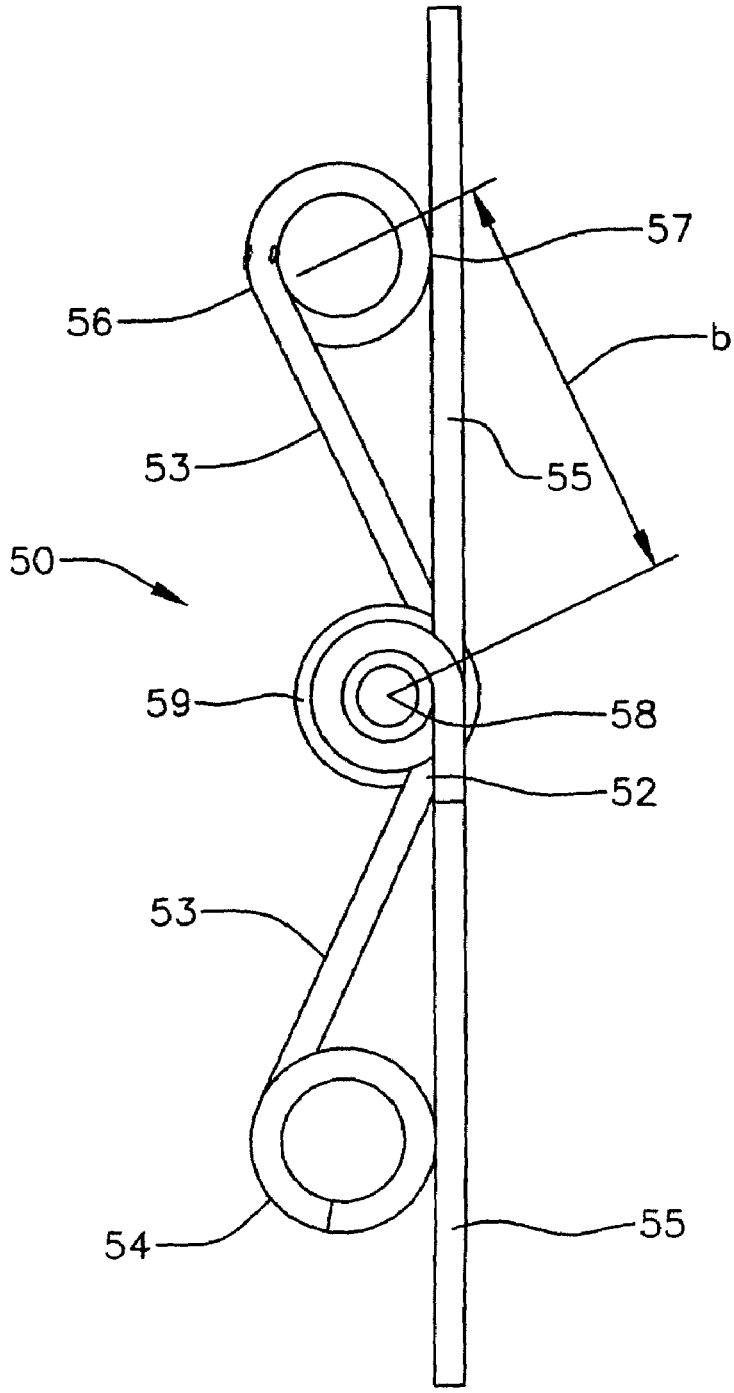
FIG. 7 shows an assembled end view of the spring and hinge assembly of FIG. 6.

FIG. 7 shows an assembled end view of the spring and hinge assembly of FIG. 6. In an exemplary embodiment, the spring arms 53 of the spring 50 extend tangentially from the coil body 59 outwards from coil tangent points 52 and connect tangentially to the spring loops 54 at the distal ends 56 of the spring arms 53. When the torsion spring 50 is in an installed state in a hinge assembly, the spring loops 54 will bear on the surface of the hinge assembly approximately at the loop contact points 57. Unlike some prior art torsion springs, the torsion spring 50 does not connect the spring coils 51 with the spring arm 53 using a reverse bend.

By adjusting the angle between the spring arms 53 of the spring 50, a greater or lesser pre-load force may be provided when the torsion spring 50 is incorporated into a hinge assembly. This force may be maintained by the use of a door stop on the door or stile of a stall in which the hinge assembly incorporating the spring 50 is used. The stop will prevent the door from swinging past the closed position and eliminating the pre-load force. This pre-load force ensures that the door is self closing and stays in the closed position when not in use, and allows a handicapped person to latch the door closed without having to manually shut the door first—a significant convenience for a wheelchair bound person.

In the embodiment of the spring 50 shown in FIG. 7, the length of the spring arms 53 together with the provision of the spring loops 54 on their ends creates a longer beam b, measured from the tangential start of the spring arms 53 leaving the coil body 59 to the contact point 57 of the spring loops 54 on the hinge halves 55. This longer beam b allows the length of the spring arms 53 to deform to a greater extent, lessening the force transferred to the coil body 59 of the spring 50. This in turn reduces stress at the base of the of the spring arms 53 where it would otherwise concentrate, reducing the possibility that the arms 53 will break at that location. In an exemplary embodiment, the length of the beam b is at least approximately two and one half times, and preferably three times that of the diameter of the coil body 59 of the spring 50.

Figure 8:
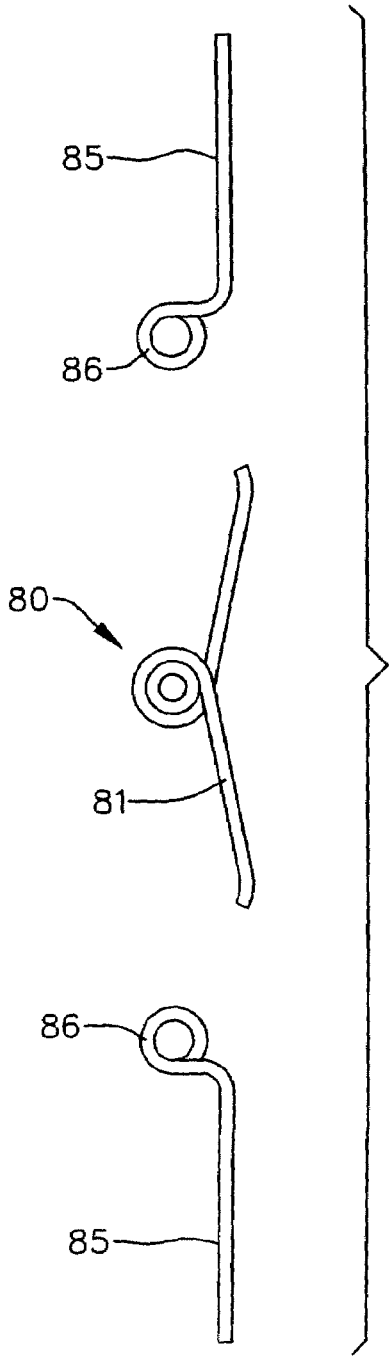
FIG. 8 shows an exploded end view of an alternative embodiment of a hinge and spring assembly according to the present invention.
Figure 9:
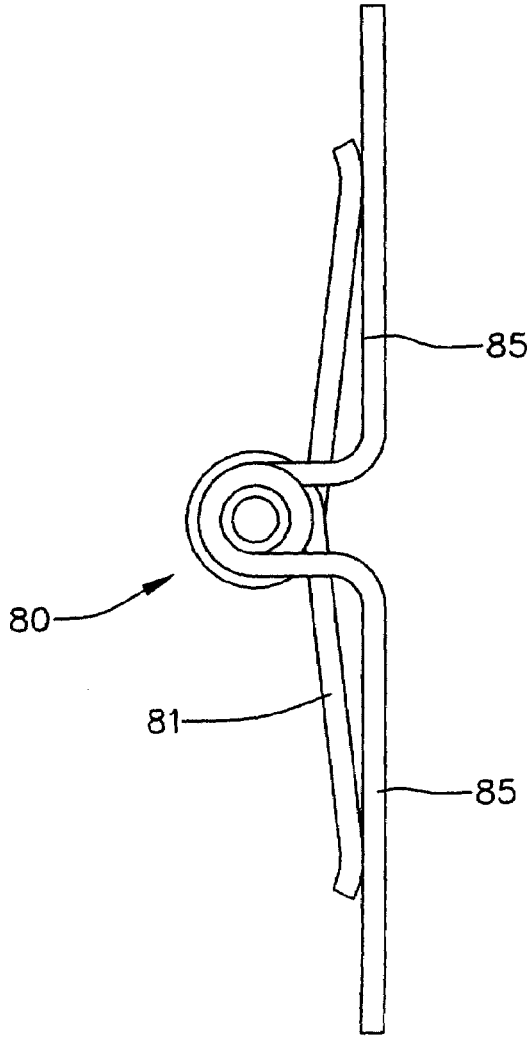
FIG. 9 shows an end view of the spring and hinge assembly of FIG. 8.

FIG. 8 shows an exploded end view of an alternative embodiment of a hinge and spring assembly according to the present invention. In this embodiment, the hinge comprises hinge halves 85 are provided with knuckles 86 formed above the surface of the hinge halves 85 to raise the position of the coiled spring body of the torsion spring 80 above the top surface of the hinge halves 85. Thus, only a small portion of the distal ends of the arms 81 contacts the hinge halves 85. Accordingly, because the arms 81 may extend outward tangentially from the spring body of the torsion spring 80 from a starting position above the surface of the hinge half 85, one can dispense with the notches in the hinge half which would otherwise be needed for proper clearance. FIG. 9 shows an end view of the spring and hinge assembly of FIG. 8.

What is claimed is:

1. A hinge assembly comprising:

a first hinge half;

a second hinge half;

a spring comprising a coil body, a first spring arm extending from the coil body having a first distal end portion, a distance between the first spring arm and the first hinge half increasing along a length of the first spring arm from the coil body to the first distal end, a second spring arm extending from the coil body having a second distal end portion, a distance between the second spring arm and the second hinge half increasing along a length of the second spring arm from the coil body to the second distal end, a first support extending from the first distal end portion towards the first hinge half and bearing on the first hinge half, the first support having a length shorter than a length of the first spring arm, the length of the first support defined by a distance between the first distal end portion and the first hinge half, a second support extending from the second distal end portion towards the second hinge half and bearing on the second hinge half, the second support having a length shorter than a length of the second spring arm, the length of the second support defined by a distance between the second distal end portion and the second hinge half; and a pin passing through the coil body of the spring joining the first hinge half and the second hinge half.

2. The hinge assembly of claim 1, wherein the first spring arm extends from the coil body to the first support without a reverse bend, and wherein the second spring arm extends from the coil body to the second support without a reverse bend.

3. The hinge assembly of claim 1, wherein the spring is a torsion spring fashioned from a single piece of wire.

4. The hinge assembly of claim 1, wherein the first support and the second support are each looped members comprising multiple individual coils.

5. The hinge assembly of claim 4, wherein the coil body of the spring is coiled in a first direction, and the first looped member and the second looped member are coiled in a second direction different from the first direction.

6. The hinge assembly of claim 1, wherein the first hinge half includes a notch to accommodate the first spring arm and the second hinge half includes a notch to accommodate the second spring arm.

7. The hinge assembly of claim 1, wherein the first support extends from the first distal end portion at a location substantially perpendicular to the first hinge half, and wherein the second support extends from the second distal end portion at a location substantially perpendicular to the second hinge half.

8. The hinge assembly of claim 1, wherein the first spring arm extends from the coil body without contacting the first hinge half, and wherein the second spring arm extends from the coil body without contacting the second hinge half.

9. A hinge assembly comprising:

a first hinge half;

a second hinge half;

a spring comprising a coil body, a first spring arm extending from the coil body having a first distal end portion, a second spring arm extending from the coil body having a second distal end portion, a first support extending from the first distal end portion towards the first hinge half and bearing on the first hinge half, a second support extending from the second distal end portion towards the second hinge half and bearing on the second hinge half; and a pin passing through the first hinge half, the second hinge half and the coil body of the spring joining the first hinge half and the second hinge half;

wherein the first spring arm extends from the coil body to the first support without a reverse bend; and wherein the second spring arm extends from the coil body to the second support without a reverse bend.

10. The hinge assembly of claim 9, wherein the first support extends from the first distal end portion at a location substantially perpendicular to the first hinge half, and wherein the second support extends from the second distal end portion at a location substantially perpendicular to the second hinge half.

11. A hinge assembly comprising:

a first hinge half;

a second hinge half;

a spring comprising a coil body, a first spring arm extending from the coil body having a first distal end portion, a distance between the first spring arm and the first hinge half increasing along a length of the first spring arm from the coil body to the first distal end portion, a second spring arm extending from the coil body having a second distal end portion, a distance between the second spring arm and the second hinge half increasing along a length of the second spring arm from the coil body to the second distal end portion, a first looped support extending from the first distal end portion towards the first hinge half, a portion of the first looped support opposite to the first distal end portion bearing on the first hinge half;

a second looped support extending from the second distal end portion towards the second hinge half, a portion of the second looped support opposite the second distal end portion bearing on the second hinge half; and a pin passing through the coil body of the spring joining the first hinge half and the second hinge half.

12. The hinge assembly of claim 11, wherein the first support extends from the first distal end portion at a location substantially perpendicular to the first hinge half, and wherein the second support extends from the second distal end portion at a location substantially perpendicular to the second hinge half.

13. A hinge assembly comprising:

a first hinge half;

a second hinge half;

a spring comprising a coil body, a first spring arm extending from the coil body having a first distal end portion, the first spring arm extending from the coil body along a tangent of the coil body to the first distal end, a second spring arm extending from the coil body having a second distal end portion, the second spring arm extending from the coil body along a tangent of the coil body to the second distal end, a first support extending from the first distal end portion towards the first hinge half and bearing on the first hinge half, a second support extending from the second distal end portion towards the second hinge half and bearing on the second hinge half; and a pin passing through the first hinge half, the second hinge half and the coil body of the spring joining the first hinge half and the second hinge half.

14. The hinge assembly of claim 13, wherein the first spring arm extends from the coil body without contacting the first hinge half, and wherein the second spring arm extends from the coil body without contacting the second hinge half.

15. The hinge assembly of claim 13, wherein the first hinge half includes a notch to accommodate the first spring arm and the second hinge plate includes a notch to accommodate the second spring arm.

16. The hinge assembly of claim 13, wherein the spring is a torsion spring fashioned from a single piece of wire.

17. The hinge assembly of claim 13, wherein the first support and the second support are each looped members comprising multiple individual coils.

18. A hinge assembly comprising:

a first hinge half defined by a planar surface having an inner edge, an outer edge and a first notch in the inner edge, the first notch passing through the first hinge half;

a second hinge half defined by a planar surface having an inner edge, an outer edge and a second notch in the inner edge, the second notch passing through the second hinge half;

a spring comprising a coil body, a first spring arm extending from the coil body through the first notch, the first spring arm having a first distal end portion, a second spring arm extending from the coil body through the second notch, the second spring arm having a second distal end portion, a first support extending from the first distal end portion towards the first hinge half and bearing on the first hinge half, a second support extending from the second distal end portion towards the second hinge half and bearing on the second hinge half; and a pin passing through the coil body of the spring joining the first hinge half and the second hinge half.

19. The hinge assembly of claim 18, wherein the first support extends from the first distal end portion at a location substantially perpendicular to the first hinge half, and wherein the second support extends from the second distal end portion at a location substantially perpendicular to the second hinge half.

20. The hinge assembly of claim 18, wherein the first spring arm extends from the coil body without contacting the first hinge half, and wherein the second spring arm extends from the coil body without contacting the second hinge half.

21. The hinge assembly of claim 18, wherein the first spring arm extends from the coil body to the first distal end portion without a reverse bend, and wherein the second spring arm extends from the coil body to the second distal end portion without a reverse bend.

22. The hinge assembly of claim 18, wherein the spring is a torsion spring fashioned from a single piece of wire.

23. The hinge assembly of claim 18, wherein the first support and the second support are each looped members comprising multiple individual coils.

* * * * *